United States Patent [19]

Hirabayashi et al.

[11] 4,181,443

[45] Jan. 1, 1980

[54] DRIVE MECHANISM FOR A RECIPROCATING PRINTER CARRIAGE

[75] Inventors: Tetsuro Hirabayashi; Hiromi Shishiuchi, both of Shiojiri, Japan

[73] Assignees: Kabushiki Kaisha Suwa Seikosha; Shinshu Seiki Kabushiki Kaisha, both of Tokyo, Japan

[21] Appl. No.: 859,502

[22] Filed: Dec. 9, 1977

[30] Foreign Application Priority Data

Dec. 9, 1976 [JP] Japan ..... 51-147963

[51] Int. Cl.[2] ..... B41J 19/22

[52] U.S. Cl. ..... 400/320; 400/317.1; 400/322

[58] Field of Search ..... 74/37; 400/317.1, 317.3, 400/320, 320.1, 321–323, 323.1, 328

[56] References Cited

U.S. PATENT DOCUMENTS

| | | | |
|---|---|---|---|
| 2,911,835 | 11/1959 | Smith | 74/37 |
| 2,939,321 | 6/1970 | Shovic | 74/37 X |
| 3,303,513 | 2/1967 | Woods et al. | 74/37 X |
| 3,318,431 | 5/1967 | La Pointe et al. | 400/320 |
| 3,489,020 | 1/1970 | Angst | 74/37 |
| 3,726,381 | 4/1973 | Murphy | 400/196.1 |
| 3,819,028 | 6/1974 | Drillick | 400/320 X |
| 3,945,022 | 3/1976 | Distler | 400/322 X |
| 4,050,564 | 9/1977 | Carmichael et al. | 400/320 X |
| 4,076,111 | 2/1978 | Robinson et al. | 400/322 X |
| 4,084,681 | 4/1978 | Heinzl et al. | 400/341 X |

FOREIGN PATENT DOCUMENTS

| | | | |
|---|---|---|---|
| 2309340 | 11/1976 | France | 400/320 |
| 1911226 | 9/1970 | Fed. Rep. of Germany | 400/322 |
| 350001 | 5/1931 | United Kingdom | 400/317.3 |

*Primary Examiner*—Paul T. Sewell

*Attorney, Agent, or Firm*—Blum, Kaplan, Friedman, Silberman & Beran

[57] ABSTRACT

A printer including a print head adapted for reciprocal displacement across a print tape for effecting printing on the tape in at least one direction of the displacement is provided. The print head is engaged with a timing belt operatively coupled to a drive assembly for selectively advancing the belt in one direction either intermittently or continuously. A direction shift assembly is provided for selectively operatively coupling the print head to the timing belt at either of two locations for selectively displacing the print head in opposed directions. The printer also includes a clutch assembly for selectively transmitting unidirectional rotation power from a motor to the timing belt.

20 Claims, 4 Drawing Figures

FIG. 2
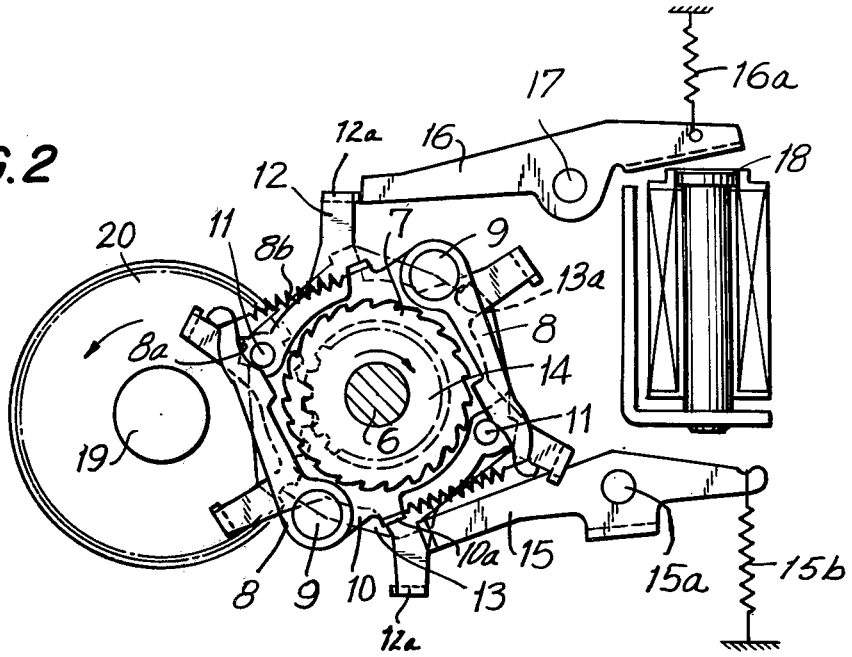
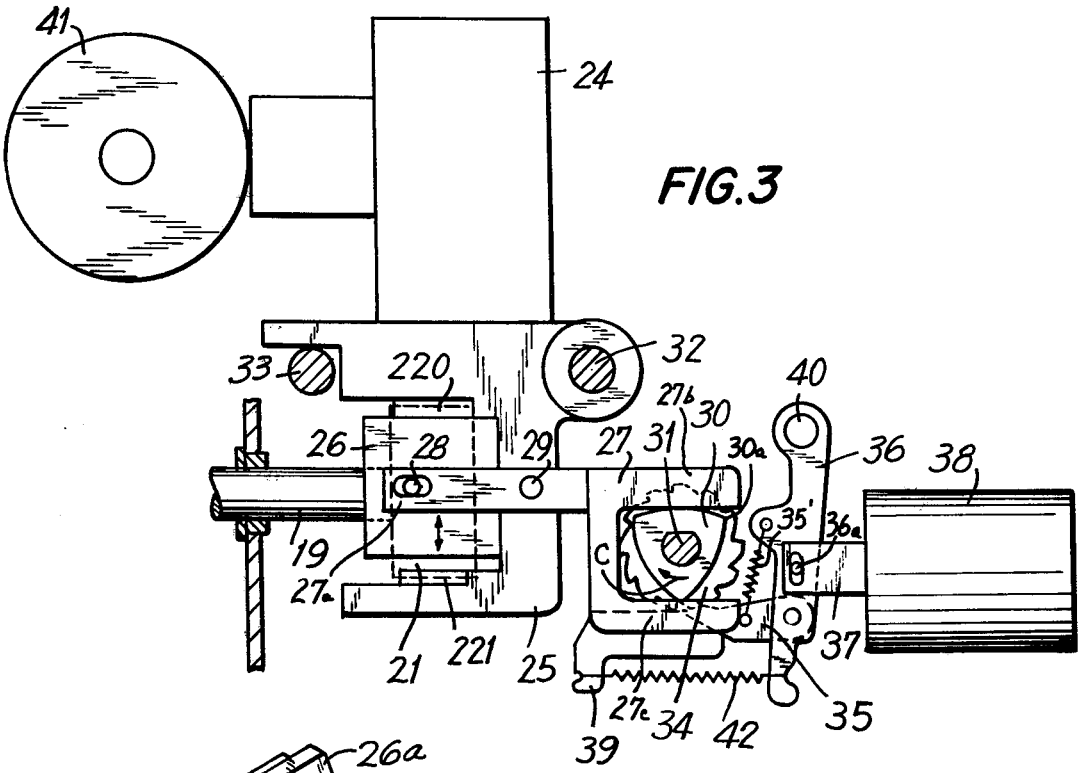
FIG. 3
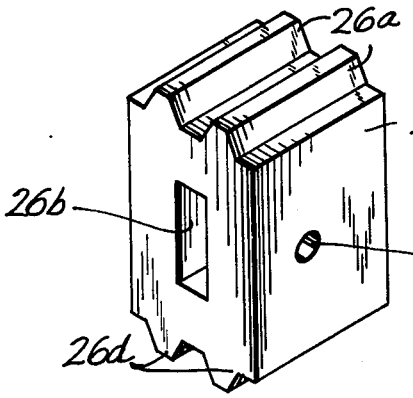
FIG. 4

DRIVE MECHANISM FOR A RECIPROCATING PRINTER CARRIAGE

BACKGROUND OF THE INVENTION

This invention relates generally to a printer, and particularly to a printer including a print head which is adapted to be displaced reciprocatively across a print tape.

In conventional reciprocating printers two methods are used for printing characters on a print tape, namely, by the continuous reciprocating displacement of a print head or by the intermittent reciprocating displacement of the print head. In the case a continuously reciprocating print head is used, the print head is displaced by a low-priced mechanism utilizing a timing belt or a drum cam. This method is advantageous based on its price, however, the print head cannot be displaced intermittently and cannot be stopped selectively at a desired position across the print tape. In the case of a printer utilizing intermittent reciprocating displacement of the print head, the print head is driven by a pulse motor or a servomotor and control circuit. This latter method is disadvantageous due to the increased cost of the motors and complex control circuit. Accordingly, it is desirable to provide a low-priced reciprocating printer wherein the print head can be reciprocatively displaced both continuously and intermittently which overcomes the disadvantages inherent in the conventional reciprocating printers.

SUMMARY OF THE INVENTION

Generally speaking, in accordance with the invention, a printer including a print head which is displaced reciprocatively across a print tape for printing characters on the tape in at least one direction of the displacement is provided. The print head is slideably mounted on a frame and selectively engaged with a timing belt for effecting displacement of the print head. The printer includes a direction shift assembly for operatively selectively coupling the print head and the timing belt at either of two locations for selectively displacing the print head in the two directions of its reciprocation. The drive assembly includes a clutch assembly for selectively coupling a motor to the timing belt for selectively driving the belt and print head intermittently or continuously.

Accordingly, it is an object of this invention to provide an improved reciprocating printer.

Another object of this invention is to provide an improved printer including a reciprocating print head which can be displaced selectively either intermittently and continuously across a print tape.

A further object of this invention is to provide an improved printer including a reciprocating print head displaced by a timing belt.

Still another object of this invention is to provide an improved printer including a reciprocating print head driven by a timing belt and an improved clutch assembly.

Still a further object of this invention is to provide an improved printer including a reciprocating print head displaced by a timing belt and an improved direction shift assembly for reversing the displacement direction of the print head.

Still another object of this invention is to provide an improved one-way clutch assembly.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompany drawings, in which:

FIG. 2 is a side elevational view of a one-way mechanical clutch assembly of the printer illustrated in FIG. 1;

FIG. 3 is a side elevational view of a print head direction shift assembly of the printer illustrated in FIG. 1; and FIG. 4 is a perspective view of a timing belt shift plate utilized in the shift assembly depicted in FIG. 3.

DESCRIPTION OF THE PREFERRED EMBODIMENTS

Figure 1:
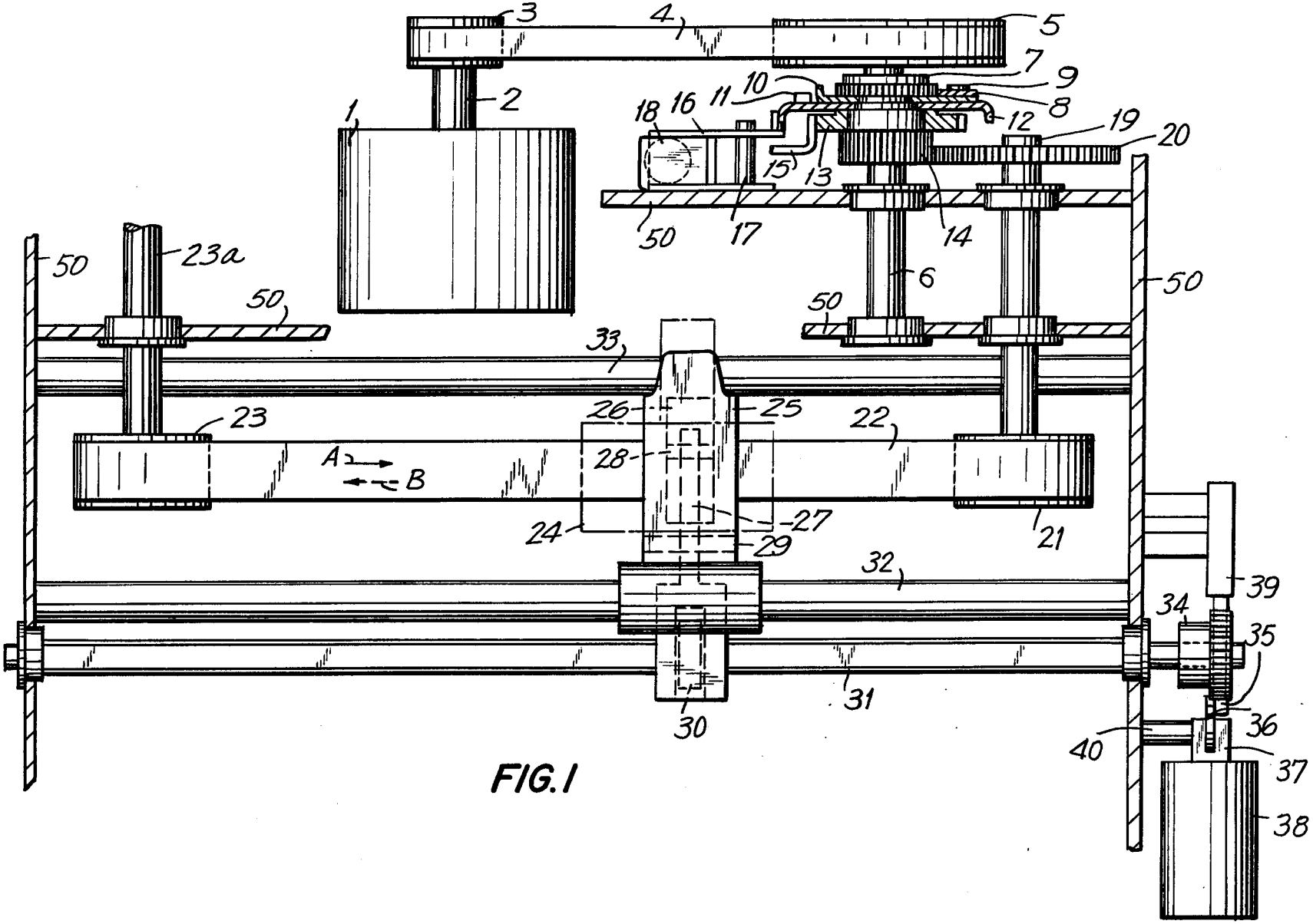
FIG. 1 is a plan view of a printer constructed and arranged in accordance with the invention.

Referring now to FIG. 1, a reciprocating printer constructed and arranged in accordance with the invention is shown. The printer includes a print assembly including a print head 24 fixed on a print head attachment member 25 which is slideably mounted on a first guide shaft 32 and a second guide shaft 33 fixed to a portion of a frame 50 and adapted to permit displacement of print head 24 across a print tape (not shown) for printing characters in at least one direction of the displacement of print head 24. A drive assembly including a motor 1 mounted on frame 50 and a clutch sub-assembly for selectively operatively coupling motor 50 and a timing belt 22 for effecting displacement of print head 24. A print head direction shift assembly includes a shift lever 27 and a shift plate 26 for selectively coupling with an upper run 220 or a lower run 221 of timing belt 22 to print head attachment member 25 for effecting a change in the direction of displacement of print head 24.

Motor 1 of the drive assembly includes a rotating motor shaft 2 and a drive pulley 3 fixed thereto. A clutch pulley 5 is fixed to a clutch shaft 6 rotatably mounted to a portion of frame 50. A drive belt 4 is engaged with drive pulley 3 and clutch pulley 5 for effecting unidirection rotation of a ratchet wheel 7 fixed to clutch shaft 6.

Referring specifically to FIG. 2, the mechanical clutch sub-assembly includes two pawls 8, each pivotally mounted at one end thereof to a pawl shaft 9 fixed to a disc plate 10 rotatably mounted on clutch shaft 6. The other free end of each pawl 8 is formed with a concave portion **8*a* and is biased toward clutch shaft 6 by a pawl spring 8*b* secured between the free end of pawl 8 and a projection 10*a* formed in disc plate 10. A stopper shaft 11 is provided for each pawl and is fixed to a clutch plate 12 rotatably mounted to clutch shaft 6 and adapted to engage pawl 8 proximate concave portion 8*a* for maintaining pawl 8 in a first position out of engagement with ratchet wheel 7. Clutch plate 12 is formed with a plurality of trigger engaging fingers 12*a* for selectively engaging a trigger lever 16 pivotally mounted on a trigger shaft 17 to frame 50. Trigger lever 16 is biased towards a first position in engagement with trigger engaging finger 12a by a trigger spring 16a fixed to frame 50. An electromagnet 18 mounted on frame 50 is selectively energized by a signal from a control circuit (not shown) for pivoting trigger lever 16 from its first position in engagement with trigger engaging finger 12a to a second position not in engagement with trigger engaging finger 12a. A gear wheel 14 is fixed to a disc plate 10 and mounted rotatably on clutch shaft 6 and engaged with a belt gear wheel 20 fixed to a gear shaft 19 rotatably mounted on a portion of frame 50**.

When electromagnet 18 is energized trigger lever 16 is displaced from its first position to its second position disengaging from trigger engaging finger 12a. The biasing action of pawl spring 8b pivots pawl 8 from its first position away from clutch shaft 6 to its second position towards clutch shaft 6 displacing stopper shaft 11 and rotating clutch plate 12 in the direction of rotation of clutch shaft 6 and ratchet wheel 7 bringing pawl 8 into engagement with ratchet wheel 7.

When both pawls 8 are engaged with ratchet wheel 7, disc plate 10 is rotated about clutch shaft 6 in the direction of rotation of ratchet wheel 7. Gear wheel 14 fixed to disc plate 10 is rotated in the direction of ratchet wheel 7. Belt gear wheel 20 fixed on gear shaft 19 and engaged with gear wheel 14 is rotated in the direction opposite to clutch shaft 6. Clutch plate 12 also is rotated in the direction of ratchet wheel 7 in response to engagement between the concave portions 8a of both pawls 8 and stopper shafts 11. This rotation of clutch plate 12 and gear wheel 14 continues until electromagnet 18 is de-energized in response to a signal from the control circuit and trigger lever 16 is returned to its first position engaging a rotating trigger engaging finger 12a due to the biasing force of trigger lever spring 16b. When trigger lever 16 engages trigger engaging finger 12a, clutch plate 12 stops rotating and both pawls 8 are disengaged from ratchet wheel 7 as pawls 8 ride over stopper shafts 11 in a camming fashion disengaging stopper shafts 11 from engagement with concave portions 8a. When both pawls 8 are returned to their first position engaging from ratchet wheel 7, gear wheel 14 stops rotating about clutch shaft 6.

The clutch sub-assembly includes a location plate 13 fixed to clutch plate 12 and rotatably mounted on clutch shaft 6. Location plate 13 is formed with a plurality of projections 13a for engaging a location lever 15 which is pivotally mounted on a location lever shaft 15a on frame 50 and biased towards clutch shaft 6 by action of a location spring 15b for preventing the disengagement of clutch trigger engaging fingers 12a from trigger lever 16.

Referring now to FIG. 1, a belt drive pulley 21 is fixed to gear shaft 19 and a second belt pulley 23 placed apart therefrom is fixed to a pulley shaft 23a rotatably mounted to a portion of frame 50. Belt pulleys 21 and 23 are positioned on frame 50 so that timing belt 22 is selectively engageable between print head attachment member 25 and shift plate 26 for displacing print head 24 across a platen 41, shown in FIG. 3, for printing in at least one direction of the displacement of print head 24. Timing belt 22 is formed with a plurality of inwardly facing teeth forming upper run 220 and lower run 221 for selective engagement with selectively displaceable shift plate 26 pivotally mounted to shift lever 27.

Referring specifically to FIG. 4, shift plate 26 is shown in perspective formed in the shape of a block having two teeth 26a on its upper surface and two teeth 26d on its lower surfaces. Teeth 26a and 26d are shaped to enegage cooperatively the teeth forming upper and lower run 220 and 221 of timing belts 22. Shift plate 26 is formed further with an opening 26b for receiving a shift lever arm 27a of shift lever 27 and a hole 26c for receiving a pin 28 for pivotally mounting shift plate 26 on shift lever 27.

Referring now to FIGS. 1 and 3, print head attachment member 25 is slideably mounted on guide shafts 32 and 33 for guiding print head 24 across the print tape. As belt driving pulley 21 is rotated in one direction only upper run 220 of timing belt 22 is driven in arrow direction A and lower run 221 of timing belt 22 is driven in arrow direction B. When shift plate 26 is in its first upward position, teeth 26a are engaged with upper run 220 of timing belt 22. When shift plate 26 is in its second downward position, teeth 26b engage lower run 221 of timing belt 22. When teeth 26a are engaged with upper belt run 220 on teeth 26b or engaged with lower belt run 221, belt 22 is compressed between shift plate 26 and print head attachment member 25 and print head 24 mounted on print head attachment member 25 is displaced in the direction of arrows A or B.

The upward and downward displacement of shift plate 26 and in turn the direction shift of print head 24 is effected by a print direction shift assembly illustrated in FIG. 3. A solenoid 38 having a plunger shaft 37 is mounted to frame 50. Plunger shaft 37 is shown in its first position away from solenoid 38. A pawl lever 36 is pivotally mounted at one end on a pawl lever shaft 40 fixed to frame 50. Pawl lever 36 is pivotally mounted to plunger shaft 36 by a pin 36a. A pawl 35 is pivotally mounted proximate the other end of pawl lever 36 and biased by a pawl spring 43 towards a cam shaft 31 rotatably mounted on frame 50. Cam shaft 31 passes between two cam engaging fingers 27b and 27c formed at the cam end of shift lever 27. A spring 42 mounted between a stopper 39 mounted on frame 50 and a pawl lever 36 biases pawl lever 36 towards its first position in the direction of cam shaft 31. Stopper 39 is positioned to impart a camming action to pawl 35 so it will engage a ratchet wheel 34 fixed to cam shaft 31 and maintain the position of ratchet wheel 34.

When solenoid 38 is energized by a signal from the control circuit, plunger shaft 37 is displaced to its second position towards solenoid 38. Pawl lever 36 is pivoted to its second position away from cam shaft 31. When solenoid 38 is de-energized, plunger shaft 37 is returned to its first position by biasing action of spring 42. Pawl lever 36 is pivoted towards cam shaft 31 and pawl 35 biased towards cam shaft 31 by pawl spring 35' is pivoted towards cam shaft 31 engaging pawl 35 and ratchet wheel 34. When pawl 35 is engaged with ratchet wheel 34, cam shaft 31 is rotated causing a cam 30 slideably mounted thereon and positioned so as to be engaged between cam fingers 27b and 27c of shift lever 27 and shift lever 27 is pivoted about pin 29. Cam 30 is formed with three cam points 30a for alternately engaging cam engaging finger 27b and 27c of shift lever 27. As shift lever 27 is pivoted, shift plate 26 is displaced upwardly or downwardly so as to engage upper or lower belt run 220 and 221 of belt 22. When solenoid 38 is alternately energized and de-energized, plunger shaft 37 is reciprocated and cam shaft 31 is rotated a predetermined amount turning cam 30 so as to displace alternately belt holding member 26 from its first position to its second position in engagement with timing belt 22.

Operation of the printer is as follows. When current flows to motor 1, motor shaft 2 is rotated in the clockwise direction rotating drive pulley 3, driving drive belt 4. Rotating pulley 3 drives belt 4 rotating clutch pulley 5 and clutch shaft 6 in the same direction. When electromagnet 18 is energized selectively by a signal from the control circuit, trigger lever 16 is pivoted from its first position in engagement with clutch plate finger 12*a* to its second position out of engagement with clutch plate finger 12*a*. Clutch plate 12 is now free to rotate about clutch shaft 6 in the direction of rotating ratchet wheel only. Pawls 8 are pivoted from their first position away from clutch shaft 6 to their second position towards clutch shaft 6 due to the biasing force of pawl springs 8*a*. Pawls 8 pivot to their second position displacing stopper shaft 11 and thereby rotating clutch plate 12 about clutch shaft 6 in the direction of rotating ratchet wheel 7. Pawl 8 is pivoted until concave portion 8*a* of pawl 8 engages stopper shaft 11 and pawl 8 is engaged by ratchet wheel 7 rotating in the clockwise direction. When pawl 8 is engaged disc plate 10 and gear wheel 14 mounted to disc plate 10 rotate in the clockwise direction of FIG. 2. Belt gear wheel 20 which is engaged with gear wheel 14 rotates in the counterclockwise direction imparting a counterclockwise directional rotation to gear shaft 19 and belt drive pulley 21 mounted thereto. As belt drive pulley 21 is rotated in the counterclockwise direction top belt run 220 of timing belts 22 is driven in the direction of arrow A and bottom belt run 221 of timing belt 22 is driven in the direction of arrow B.

When trigger lever 16 is disengaged initially from trigger engaging portions 12*a*, clutch plate 12 will not rotate about clutch shaft 6 in the direction opposite to clutch shaft 6 due to the biased engagement of location lever 15 and projection 13*a* on location plate 13. During the period electromagnet 18 is energized and the clutch assembly is operative if upper run 220 of timing belt 22 is compressed between print head attachment member 25 and shift plate 26 in its upper position as shown in FIG. 3, print head 24 is displaced in arrow direction A. At this moment if a print command signal is transmitted to print head 24, characters can be printed on the recording tape as print head 24 is displaced in the direction of arrow A. Similarly, when lower run 221 of timing belt 22 is compressed between shift plate 26 and print head attachment member 25, print head 24 is displaced in arrow direction B and may print in this direction.

When current flowing to electromagnet 18 is interrupted and a stop signal for printing is transmitted by the print control circuit, trigger lever 16 returns to its first position by the biasing force of trigger spring 16*b*. Trigger engaging finger 12*a* engages trigger lever 16 releasing pawl 8 from engagement with ratchet wheel 7 by a camming action along stopper shaft 11 as pawl 8 returns to its first disengaged position. Belt drive pulley 21 stops rotating and, as depicted in FIG. 2, print head 24 stops in the location of displacement when the signal was applied.

The mechanical clutch assembly is constructed and arranged so that the intermittent engagement of the mechanical clutch assembly corresponds to the repeating action of one character pulse. As trigger engaging finger 12*a* of clutch plate 12 is engaged securely with trigger lever 16 by engagement of location plate 13 and location lever 15, the clutch may be actuated in response to a cyclical timing pulse and its rotation transmitted to belt drive pulley 21 so that print head 24 is displaced intermittently by one character pulse. In addition, the signal applied to electromagnet 18 by the control circuit may be regulated so that print head 24 is displaced continuously. In this latter mode, electromagnet 18 remains energized and print head 24 is displaced continuously across the print tape. Characters are printed on the print tape in response to timing pulses generated by the print control circuit.

A shaft in direction of print head 24 may be made at any location of its displacement or at the end of each print line. Print head displacement direction is shifted during the period the clutch assembly is disengaged, that is when electromagnet 18 is de-energized. At this time current is applied to solenoid 38, plunger shaft 37 is drawn to its second position towards solenoid 38 when current is turned off plunger shaft returns to its first position towards cam shaft 31. Pawl 35 is engaged with ratchet wheel 34, rotating ratchet wheel 34 in arrow direction C and cam shaft 31 is rotated.

As cam shaft 31 is rotated, cam 30 slideably mounted thereon rotates disengaging cam point 30*a* from one shift lever cam surface and engages another cam point 30*a* with the second shift lever cam surface. When this occurs, shift lever 27 is pivoted about shift lever pin 29.

When shift lever cam finger 27 and 27*b* are pivoted upwardly about pin 29, belt holding member 26 is displaced downwardly to engage lower run 221 of timing belt 22. Print head attachment member 25 and print head 24 are displaced in arrow direction B when current flows in electromagnet 18 and the clutch sub-assembly is engaged. When solenoid 38 is energized and shift lever cam fingers 27*b* and 27*c* are pivoted downwardly by rotation of cam 30, shift plate 26 is displaced upwardly so as to engage upper run 220 of belt 22. In this configuration print head 24 is displaced in arrow direction B when current flows in electromagnet 18 and the clutch sub-assembly is engaged. In both cases timing belt 22 is driven in one direction only and the direction of displacement of print head 24 may be regulated by application of a signal to energize solenoid 38.

As mentioned above, print head 24 can be displaced in either direction across the print tape either intermittently or continuously by controlling the timing of the signals applied to electromagnet 18. Moreover, displacement of a shift plate 26 can be performed accurately because it is done while the clutch assembly is disengaged and timing belt 22 is in a rest position. Thus, a printer constructed and arranged in accordance with the invention including a print head direction shift assembly as described enables the reciprocating printer to be operated by a motor which rotates in one direction only. Moreover, because printing head 24 is displaced at a constant speed, a motor of relatively low output and constant speed can be used. In addition, either intermittent displacement or continuous displacement together with the reciprocating displacement of print head 24 can be performed easily by controlling the signals applied to electromagnet 18 and solenoid 38 so that the controlling circuit for regulating displacement of print head 24 need not be complex, resulting in significant cost savings.

The printer constructed and arranged in accordance with the above described embodiment of the invention utilizes a timing belt formed from a flexible material and formed with a plurality of inwardly facing teeth or ribs as the means for displacing the print head assembly. It is also possible to displace the print head assembly by a timing belt formed from a metallic material which is formed with sprockets adapted to engage teeth on the pair of pulleys. In addition, the above described embodiment employs a mechanical clutch assembly including pawls and a ratchet wheel as the means for transmitting the rotational power from the motor to the driven shaft for displacing the print head assembly, however, it is possible to employ a frictional or electromagnetic clutch. Moreover, any means which will displace the shift plate may be substituted for the rotating cam shaft actuated by the electromagnet and pawls.

Accordingly, by constructing and arranging a printer including a print head to be reciprocatively displaced across a recording tape for recording characters thereon in accordance with the invention, the print head may be displaced intermittently or continuously without having to use a high-priced pulse motor or servomotor with its corresponding complex controlling circuit. In addition, it is possible to utilize the relatively inexpensive mechanisms previously used in continuously reciprocating printers for performing the continuous or intermittent displacement of the print head in accordance with the invention. Additionally, the absence of any complex electrical controlling circuits and relatively simple mechanical assemblies insures an increase in the reliability of the printer.

It will thus be seen that the objects set forth above, among those made apparent from the preceding description, are efficiently attained and, since certain changes may be made in the above construction without departing from the spirit and scope of the invention, it is intended that all matter contained in the above description are shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A printer for printing on print tape means comprising:

a frame;

print means slideably mounted on said frame for reciprocative displacement across the tape means for effecting printing in at least one direction of said displacement;

unidirectional drive means mounted on said frame;

two spaced apart pulleys rotatably mounted on said frame, one of said pulley selectively operatively coupled to said drive means;

an endless belt having two runs mounted on said pulleys, said endless belt formed with engagement means;

clutch means for selectively operatively coupling said one pulley to said drive means; and displacement means selectively operatively coupling said print means to said belt at either of said runs for selectively displacing print means in opposed directions for said reciprocal displacement, said displacement means including direction shift means and a coupling member adapted to cooperate with said engagement means on said belt runs, said direction shift means including lever means pivotally mounted on said print means and ratchet means mounted on said frame and operatively coupled to said lever means for pivoting said lever means between a first position and a second position for displacing said coupling means mounted on said lever means from engagement with one of said belt runs.

2. The printer of claim 1, wherein said engagement means formed on said belt is a plurality of inwardly facing projections and said coupling means is a coupling member formed with at least one matching projection on opposite surfaces thereof.

3. The printer of claim 1, including cam means for operatively coupling said lever means and said ratchet means for effecting pivoting of said lever means in response to selective rotation of said ratchet means.

4. The printer of claim 1, wherein said ratchet means includes a ratchet wheel rotatably mounted on said frame and pawl means adapted to be selectively displaced between a first position in engagement with said ratchet wheel and a second position out of engagement with said ratchet wheel for effecting rotation of said ratchet wheel, said lever means operatively engaging to said ratchet wheel.

5. The printer of claim 4, including cam means for operatively engaging said lever means and said ratchet wheel.

6. The printer of claim 5, wherein said lever means is a lever formed with a cam means engaging portion at one end thereof for operatively engaging said cam means, said coupling means mounted on the other end of said lever.

7. The printer of claim 6, wherein said cam means includes a cam shaft rotatably mounted on said frame and a cam slideably mounted on said cam shaft and engaged by said cam means engaging portion of said lever, said ratchet wheel fixed to said cam shaft, said cam adapted to be rotated in response to rotation of said ratchet wheel for effecting displacement of said lever between a first position and a second position for displacing said coupling means between a first position and a second position in engagement with said belt.

8. The printer of claim 7, wherein said pawl means includes a pawl and solenoid means operatively coupled to said pawl for displacing said pawl between a first position in operative engagement with said ratchet wheel and a second position out of engagement with said ratchet wheel when said solenoid means is selectively actuated.

9. The printer of claim 8, including biasing means for biasing said pawl into engagement with said ratchet wheel.

10. The printer of claim 1, including one-way clutch means mounted on said frame for selectively operatively coupling said drive means to said belt means for selectively driving said belt means.

11. The printer of claim 10, wherein said clutch means includes a clutch shaft rotatably mounted on said frame and operatively coupled to said drive means, ratchet means fixed to said shaft, gear means rotatably mounted on said shaft, pawl means mounted on said gear means for selective engagement with said ratchet means and trigger means for selectively displacing said pawl means between a first position out of engagement with said ratchet means and a second position in engagement with said ratchet means for rotating said gear means in response to rotation of said ratchet means, said gear means operatively engaged with one of said pulleys.

12. The printer of claim 11, wherein said trigger means includes clutch plate means mounted on said gear means and lever means selectively engageable with said clutch plate means.

13. The printer of claim 12, wherein said lever means includes a lever pivotally mounted on said frame and electromagnet means mounted on said frame and adapted to displace said lever between a first position in engagement with said clutch plate means and a second position out of engagement with said clutch plate means for selectively displacing said pawl means between a first position and a second position for rotating said gear means.

14. The printer of claim 13, wherein said clutch plate means includes a clutch plate formed with at least one projecting finger engageable with said lever and at least one stopper mounted on said clutch plate and adapted to engage said pawl means for maintaining said pawl means in its first position out of engagement with said ratchet means.

15. The printer of claim 13, wherein said clutch means includes location means for regulating the rotational position of said clutch plate.

16. The printer of claim 15, wherein said location means includes location plate means fixed to said clutch plate and adapted to rotate about said clutch shaft and lever means rotatably mounted on said frame and biased into engagement with said location plate means.

17. In a printer including a frame, print means slideably mounted on said frame for reciprocative displacement across a print tape for printing characters on said tape in at least one direction of the reciprocation of said print means, endless belt means selectively operatively coupled to said print means for effecting said displacement, and unidirectional drive means for driving said endless belt means, the improvement which comprises one-way clutch means including a clutch shaft rotatably mounted on said frame and operatively coupled to said drive means, ratchet means fixed to said shaft, gear means rotatably mounted on said shaft, pawl means mounted on said gear means for selective engagement with said ratchet means and trigger means including clutch plate means mounted on said gear means, a lever pivotally mounted on said frame and electromagnet means mounted on said frame and adapted to displace said lever between a first position in engagement with said clutch plate means and a second position out of engagement with said clutch plate means for selectively displacing said pawl means between a first position out of engagement with said ratchet means between a first position out of engagement with said ratchet means and a second position in engagement with said ratchet means for rotating said gear means in response to rotation of said ratchet means, said gear means operatively engaged with said endless belt means.

18. The printer of claim 17, wherein said clutch plate means includes a clutch plate formed with at least one projecting finger engageable with said lever and at least one stopper mounted on said clutch plate and adapted to engage said pawl means for maintaining said pawl means in its first position out of engagement with said ratchet means.

19. The printer of claim 18, wherein said clutch means includes location means for regulating the rotational position of said clutch plate.

20. The printer of claim 19, wherein said location means includes location plate means fixed to said clutch plate and adapted to rotate about said clutch shaft and lever means rotatably mounted on said frame and biased into engagement with said location plate means.

* * * * *